US006573654B2

(12) United States Patent
Juestel et al.

(10) Patent No.: US 6,573,654 B2
(45) Date of Patent: Jun. 3, 2003

(54) PLASMA PICTURE SCEEN WITH A TERBIUM(III)-ACTIVATED PHOSPHOR

(75) Inventors: Thomas Juestel, Aachen (DE); Hans-Helmut Bechtel, Roetgen (DE); Joachim Opitz, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/860,314

(22) Filed: May 18, 2001

(65) Prior Publication Data

US 2002/0041156 A1 Apr. 11, 2002

(30) Foreign Application Priority Data

May 19, 2000 (DE) ..... 100 24 836

(51) Int. Cl.[7] ..... H01J 29/20

(52) U.S. Cl. ..... 313/586; 584/486; 584/487; 584/467; 584/112

(58) Field of Search ..... 313/586, 584, 313/585, 485, 486, 487, 467, 112

(56) References Cited

U.S. PATENT DOCUMENTS

| | | | | | |
|---|---|---|---|---|---|
| 5,798,059 | A | * | 8/1998 | Bredol et al. | 252/301.45 |
| 6,004,481 | A | | 12/1999 | Rao | 252/301 |
| 6,008,582 | A | * | 12/1999 | Asano et al. | 313/582 |
| 6,137,459 | A | * | 10/2000 | Eida et al. | 345/76 |
| 6,288,488 | B1 | * | 9/2001 | Amemiya | 313/582 |
| 2002/0009536 | A1 | * | 1/2002 | Iguchi et al. | 427/10 |

* cited by examiner

*Primary Examiner*—Ashok Patel

(57) ABSTRACT

A plasma picture screen comprises a front plate including a glass plate on which a dielectric layer and a protective layer are provided; a carrier plate provided with a phosphor layer including a red and a blue phosphor as well as a green Tb3+-activated phosphor, with a ribbed structure which subdivides the space between the front plate and the carrier plate into gas-filled plasma cells; and a green color filter layer. One or several electrode arrays are provided on the front plate and the carrier plate for generating corona discharges in the plasma cells.

7 Claims, 2 Drawing Sheets

PLASMA PICTURE SCEEN WITH A TERBIUM(III)-ACTIVATED PHOSPHOR

FIELD OF THE INVENTION

The invention relates to a plasma picture screen provided with a front plate comprising a glass plate on which a dielectric layer and a protective layer are provided, with a carrier plate provided with a phosphor layer comprising a red and a blue phosphor as well as a green $Tb^{3+}$-activated phosphor, with a ribbed structure which subdivides the space between the front plate and the carrier plate into gas-filled plasma cells, and with one or several electrode arrays on the front plate and the carrier plate for generating corona discharges in the plasma cells.

BACKGROUND AND SUMMARY

Plasma picture screens render possible color pictures of high resolution, large screen diameter, and have a compact construction. A plasma picture screen comprises a hermetically closed glass cell which is filled with a gas, with electrodes in a grid arrangement. The application of a voltage causes a gas discharge which generates light in the ultraviolet range (145 to 185 nm). This light can be converted into visible light by phosphors and be emitted through the front plate of the glass cell to the viewer.

Phosphors which are particularly efficient under vacuum UV excitation are used for plasma picture screens. Frequently used green-emitting phosphors are, for example, $Zn_2SiO_4$:Mn (ZSM) and $BaAl_{12}O_{19}$:Mn (BAL). Both materials show a saturated green emission color with a high y-value of y>0.7. A disadvantage of both materials is their comparatively long decay time $t_{1/10}$, for example 30 ms for $Zn_2SiO_4$ with 2.5% Mn. The cause of this is that the transition $^4T_1 \rightarrow {}^6A_1$ relevant for the emission of the light is spin-forbidden. In addition, the decay time $t_{1/10}$ and the color point of an $Mn^{2+}$-activated phosphor are strongly dependent on the $Mn^{2+}$ concentration. A further disadvantage is the sensitivity of $Mn^{2+}$ to an oxidation to $Mn^{3+}$ or $Mn^{4+}$, which reduces the stability of the phosphors.

By contrast, $Tb^{3+}$-activated phosphors are temperature stable and photostable because $Tb^{3+}$ does not readily oxidize to $Tb^{4+}$. A further advantage of these phosphors over $Mn^{2+}$-activated phosphors is their shorter decay time $t_{1/10}$, which lies between 2 and 10 ms, depending on the host lattice.

U.S. Pat. No. 6,004,481 accordingly describes a green-emitting $Tb^{3+}$-activated phosphor for use in plasma picture screens which has the composition $(Y_{1-x-y-z}Gd_xTb_yCe_z)BO_3$, with 0.0<x<0.2, 0.01<y<0.1, and 0.0<z<0.1.

A major disadvantage of $Tb^{3+}$-activated phosphors is their yellowish-green color point, which has a low y-value of y<0.62.

The invention has for its object to provide a plasma picture screen with a $Tb^{3+}$-activated phosphor whose green pixels supply light with an improved color point.

This object is achieved by means of a plasma picture screen provided with a front plate comprising a glass plate on which a dielectric layer and a protective layer are provided, with a carrier plate provided with a phosphor layer comprising a red and a blue phosphor as well as a green $Tb^{3+}$-activated phosphor, with a ribbed structure which subdivides the space between the front plate and the carrier plate into gas-filled plasma cells, and with one or several electrode arrays on the front plate and the carrier plate for generating corona discharges in the plasma cells, and with a green color filter layer.

Apart from a strong emission of light with a wavelength between 540 and 550 nm, $Tb^{3+}$-activated phosphors also have emission bands, though substantially weaker, in the yellow and red spectral ranges. The intensity of these emission bands can be reduced by means of a green color filter layer, and the y-values of the color points of the $Tb^{3+}$-activated phosphors can be raised thereby. Green color filter layers absorb strongly above 580 nm, so that also the intensity of the emission lines of the neon, which lie in this spectral range and which reduce the color saturation of green- and blue-emitting phosphors, is reduced.

It is preferred that the green color filter layer lies between the dielectric layer and the protective layer.

In this case the color filter layer can be provided on a plane surface, and the layer thickness of the color filter layer will not vary in dependence on the various regions of the front plate.

It is particularly strongly preferred that the green color filter layer lies in a structured manner opposite the regions of the phosphor layer with the green Tb $^3$+-activated phosphor.

In this case, only the undesired spectral ranges of the green light emission are absorbed by the green color filter layer.

It is in addition preferred that the color filter layer comprises copper phthalocyanine or a derivative of copper phthalocyanine.

Copper phthalocyanine or a derivative of copper phthalocyanine has a high color purity and a transmission maximum at the wavelength of the light emitted by the $Tb^{3+}$-activated phosphors.

It is furthermore preferred that the green $Tb^{3+}$-activated phosphor is chosen from the group $(Y_xGd_{1-x})BO_3$:Tb ($0 \leqq x \leqq 1$), $LaPO_4$:Tb, $(Y_xGd_{1-x})_3Al_5O_{12}$:Tb ($0 \leqq x \leqq 1$), $CeMgAl_{11}O_{19}$:Tb, $GdMgB_5O_{10}$:Ce,Tb, $(Y_xGd_{1-x})_2SiO_5$:Tb ($0 \leqq x \leqq 1$), $(In_xGd_{1-x})BO_3$:Tb ($0 \leqq x \leqq 1$), $Gd_2O_2S$:Tb, LaOBr:Tb, LaOCl:Tb and $LaPO_4$:Ce,Tb.

These $Tb^{3+}$-activated phosphors are particularly efficient green-emitting phosphors when excited with VUV light.

It is advantageous that an additional red color filter layer lies in a structured manner opposite the regions of the phosphor layer with a red phosphor.

It is also advantageous that an additional blue color filter layer lies in a structured manner opposite the regions of the phosphor layer with a blue phosphor.

An additional red or blue or red and blue color filter layer enhances the LCP (Luminance Contrast Performance) value of the plasma picture screen as a whole.

BRIEF DESCRIPTION OF THE DRAWING

The invention will be explained in more detail below with reference to three Figures and two embodiments, with FIG. 1 showing the construction and operating principle of a single plasma cell in an AC plasma picture screen with a color filter layer, FIG. 2 showing the color points of $YbO_3$:Tb with and without a green color filter, and FIG. 3 showing the color points of $LaPO_4$:Ce,Tb with and without a green color filter.

DETAILED DESCRIPTION

Figure 1:
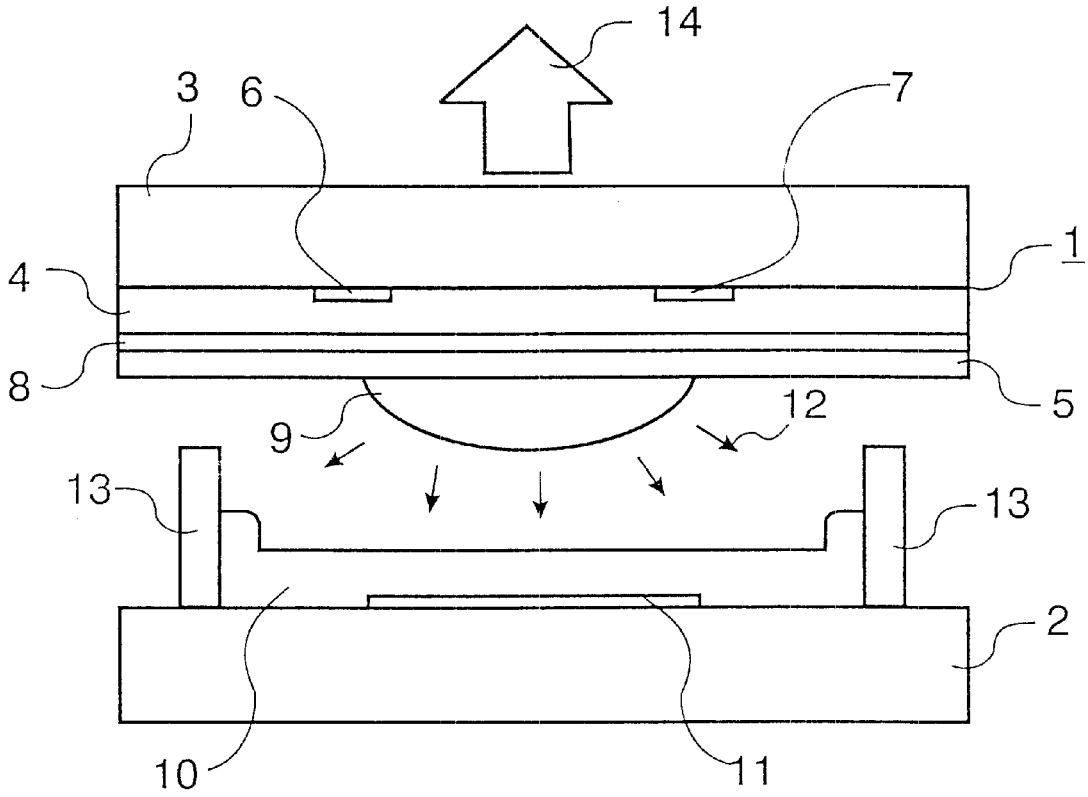

In FIG. 1, a plasma cell of an AC plasma picture screen with a coplanar arrangement of the electrodes comprises a front plate 1 and a carrier plate 2. The front plate 1 comprises a glass plate 3 on which a dielectric layer 4 and thereon a protective layer 5 are provided. The protective layer 5 is preferably made of MgO, and the dielectric layer 4 is made, for example, of glass containing PbO. Parallel, strip-shaped discharge electrodes 6, 7 are provided on the glass plate 3 and covered by the dielectric layer 4. The discharge electrodes 6, 7 are made, for example, of metal or ITO. The carrier plate 2 is made of glass, and parallel, strip-shaped address electrodes 11, for example made of Ag, are provided on the carrier plate 2 so as to run perpendicularly to the discharge electrodes 6, 7. Said address electrodes are each covered with a phosphor layer 10 which emits in one of the three basic colors red, green, or blue. The individual plasma cells are separated by a ribbed structure 13 with separation ribs preferably made of a dielectric material. A green color filter layer 8 is provided between the dielectric layer 4 and the protective layer 5.

A gas, preferably a rare gas mixture of, for example, He, Ne, or Kr, with Xe as the UV light generating component is present in the plasma cell, and also between the discharge electrodes 6, 7, which alternate in operating as the cathode and the anode. After the surface discharge has been ignited, whereby charges are enabled to flow along a discharge path lying between the discharge electrodes 6 and 7 in the plasma region 9, a plasma is formed in the plasma region 9 whereby radiation 12 in the UV range, in particular in the VUV range, is generated, depending on the composition of the gas. This radiation 12 excites the phosphor layer 10 into phosphorescence, thus emitting visible light 14 in one of the three basic colors, which light issues to the exterior through the front plate 1 and thus forms a luminous pixel on the picture screen.

The dielectric layer 4 lying over the transparent discharge electrodes 6, 7 in AC plasma picture screens serves inter alia to counteract a direct discharge between the discharge electrodes 6, 7 made of conductive material, and thus the formation of an arc during the ignition of the discharge.

To manufacture a front plate 1 with a green color filter layer 6, the discharge electrodes 6, 7 are first provided on a glass plate 3, whose size corresponds to the desired picture screen format, in a vapor deposition process and subsequent structuring. Then a dielectric layer 4 and, on the dielectric layer 4, the green color filter layer 8 are provided. A protective layer 5 is subsequently provided on the green color filter layer 8.

To manufacture the green color filter layer 8, a suitable pigment is dispersed in water by means of a stirrer or a mill, with the addition of dispersing agents. The resulting suspension is then milled in a ball mill with glass balls. The ball mill is rotated on a roller table at a speed of rotation which leads to an even rolling of the glass balls over one another, without a centrifugal effect detracting from the milling efficiency. The generation of a foam may be prevented in that a non-ionogenic anti-foaming agent is added to the suspension. The resulting suspension is then filtered through a sieving gauze.

The pigment used in the green color filter layer 8 may be copper phthalocyanine or a derivative of copper phthalocyanine such as, for example, copper-1,2,3,4,8,9,10,11,15,16,17,18,22,23,24,25-hexadecachloro-29H,31H-phthalocyanine, copper-1,2,3,4,8,9,10,11,15,16,17,18,22,23,24,25-hexadecabromo-29H,31H-phthalocyanine, or copper phthalocyanine derivatives with various kinds and numbers of halogen atoms in the substitution locations of the four benzene rings, these organic pigments, in particular copper phthalocyanine, show a high color purity, are temperature stable, withstand the rigid process conditions in the manufacture of a plasma picture screen, and show a high transmission between 520 and 550 nm, depending on the substitution.

The green color filter layer 8 may be deposited and structured by means of various processes.

One possibility is to mix the resulting suspension with a photosensitive additive which may contain, for example, polyvinyl alcohol and sodium dichromate. The suspension is then provided homogeneously on the dielectric layer 4 by means of spraying, dipping, or spin coating. The "wet" film is dried, for example by heating, infrared radiation, or microwave irradiation. The color filter layer thus obtained is exposed through a mask, and the exposed portions polymerize. The non-exposed portions are removed in that they are washed off by spraying with water.

Another possibility is formed by the so-called lift-off method. Here first a photosensitive polymer layer is provided on the dielectric layer 4 and subsequently exposed through a mask. The exposed regions become cross-linked, and the non-exposed regions are removed in a development step. The pigment suspension is deposited on the remaining polymer pattern by means of spraying, dipping, or spin coating and subsequently dried. The cross-linked polymer is converted to a soluble form by a reactive solution such as, for example a strong acid. The polymer together with the portions of the color filter layer present thereon is washed off by spraying with a developer liquid, whereas the color filter layer adhering directly to the dielectric layer 4 is not washed off.

A further possibility for manufacturing a green color filter layer 8 is the flexographic printing method. This is a method similar to a letterpress printing method in which only the regions of the dielectric layer 4 which are to be coated come into contact with the printing platen.

If the green color filter layer 8 is to have no structuring, the suspension of the green pigment may be directly provided on the dielectric layer 4 by means of spin coating, spraying, or dipping.

The green color filter layer 8 obtained has a thickness of between 0.2 and 3 $\mu$m. The viscosity of the suspension with the green pigment may be increased through the addition of an organic binder, so that a green color filter layer 8 with a layer thickness of up to 15 $\mu$m can be obtained.

Subsequently, a protective layer 5 of MgO is provided on the green color filter layer 8. The entire front plate 1 is dried and given an aftertreatment for two hours at 400° C.

It may be advantageous that in addition a red color filter layer lies in a structured manner opposite the regions of the phosphor layer 10 comprising a red phosphor, or that an additional blue color filter layer lies in a structured manner opposite the regions of the phosphor layer 10 comprising a blue phosphor, or that an additional red color filter layer lies in a structured manner opposite the regions of the phosphor layer 10 comprising a red phosphor and an additional blue color filter layer lies in a structured manner opposite the regions of the phosphor layer 10 with a blue phosphor. Pigments used for a red color filter layer may be, for example, $Fe_2O_3$, TaON, or CdS-CdSe, and pigments used for a blue color filter layer may be, for example, CoO—$Al_2O_3$ or ultramarine. The manufacture of these color filter layers takes place by one of the methods described for the manufacture of the green color filter layer 8.

The finished front plate 1 is used for the manufacture of an AC plasma picture screen together with further components such as, for example, a carrier plate 2 with address electrodes 11, which are covered with a phosphor layer 10, and with a ribbed structure 13 and a mixture of rare gases.

The green-emitting phosphor used in the phosphor layer 10 is a $Tb^{3+}$-activated phosphor such as, for example, $(Y_xGd_{1-x})BO_3$:Tb ($0 \leqq x \leqq 1$), $LaPO_4$:Tb, $(Y_xGd_{1-x})_3Al_5O_{12}$:Tb ($0 \leqq x \leqq 1$), $CeMgAl_{11}O_{19}$:Tb, $GdMgB_5O_{10}$:Ce, Tb, $(Y_xGd_{1-x})_2SiO_5$:Tb ($0 \leqq x \leqq 1$), $(In_xGd_{1-x})BO_3$:Tb ($0 \leqq x \leqq 1$), $Gd_2O_2S$:Tb, LaOBr:Tb, LaOCl:Tb or $LaPO_4$:Ce,Tb. Preferably, $LaPO_4$:Ce,Tb is used.

Methods of manufacturing such a phosphor layer 10 which may be used are both dry coating methods, for example electrostatic deposition or electrostatically supported dusting, and wet coating methods, for example silk-screen printing, dispenser methods in which a suspension is provided by means of a nozzle moving along the channels, or sedimentation from the liquid phase.

Basically, a green color filter layer 8 may be used in all types of plasma picture screens such as, for example, AC plasma picture screens with or without matrix arrangement of the electrode arrays, or DC plasma picture screens.

Figure 2:
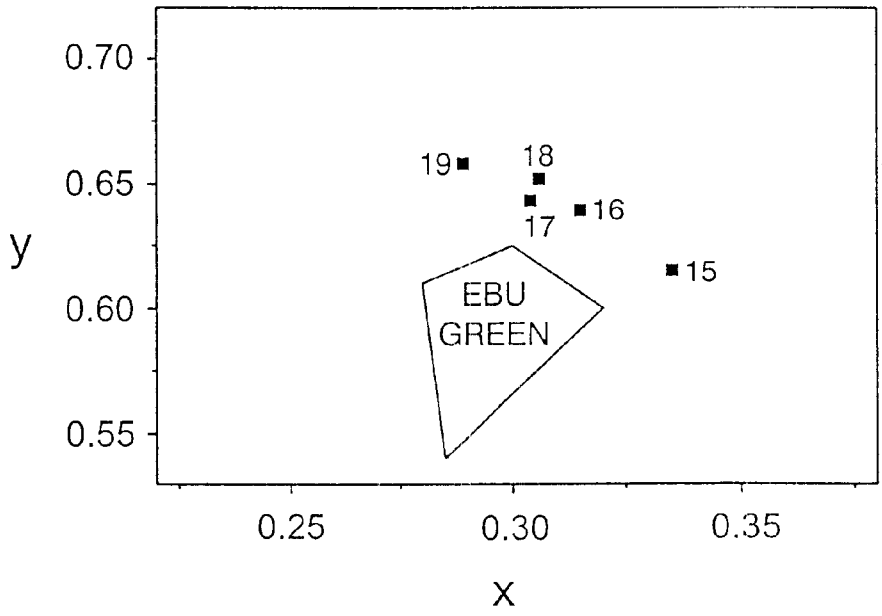
Figure 3:
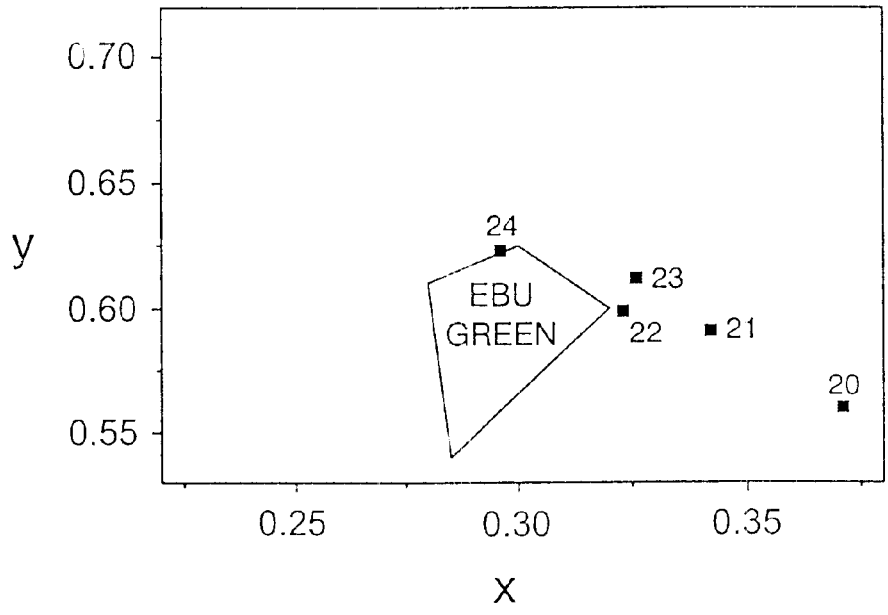

FIG. 2 and FIG. 3 show the color points of $YbO_3$:Tb and $LaPO_4$:Ce,Tb, respectively, with and without green color filter each time. It is apparent therefrom that the resulting color point depends not only on the substitution pattern of the copper phthalocyanine, but also on the layer thickness of the green color filter layer 8. The color point 15 in FIG. 2 corresponds to the color point of $YbO_3$:Tb without color filter, and the color points 16 to 19 correspond to the color points of $YbO_3$:Tb with a green color filter.

TABLE 1

Meanings of color points 16 to 19 of $YBO_3$:Tb in FIG. 2.

| Color point [No.] | Pigment in color filter layer | Thickness of color filter layer [μm] |
|---|---|---|
| 16 | $C_{32}H_2Cl_{14}N_8Cu$ | 0.5 |
| 17 | $C_{32}H_4Br_{10}Cl_2N_8Cu$ | 0.5 |
| 18 | $C_{32}H_2Cl_{14}N_8Cu$ | 10 |
| 19 | $C_{32}H_4Br_{10}Cl_2N_8Cu$ | 10 |

The color point 20 in FIG. 3 corresponds to the color point of $LaPO_4$:Tb,Ce without green color filter, and the color points 21 to 24 correspond to the color points of $LaPO_4$:Tb, Ce with a green color filter.

TABLE 2

Meanings of color points 21 to 24 of $LaPO_4$:Tb,Ce in FIG. 3.

| Color point [No.] | Pigment in color filter layer | Thickness of color filter layer [μm] |
|---|---|---|
| 21 | $C_{32}H_4Br_{10}Cl_2N_8Cu$ | 0.5 |
| 22 | $C_{32}H_2Cl_{14}N_8Cu$ | 0.5 |
| 23 | $C_{32}H_4Br_{10}Cl_2N_8Cu$ | 10 |
| 24 | $C_{32}H_2Cl_{14}N_8Cu$ | 10 |

Embodiments of the invention will be explained below, representing examples of how the invention may be realized in practice.

Embodiment 1

To manufacture a front plate 1 with a green color filter layer 8, first 62.5 g copper phthalocyanine was stirred into a dispersing agent solution comprising 31.25 g of a pigment-affinated dispersing agent in 530 g water, under vigorous stirring. The resulting suspension was mixed with 10 g of a 5% aqueous solution of a non-ionogenic anti-foaming agent and milled in a ball mill with glass balls. The ball mill was filled to such an extent that the suspension just covered the glass balls, and the rotation was set for approximately 50 rpm. A stable, fine-particle suspension was obtained after two days and was filtered through a filtering gauze.

The suspension was mixed with a 10% solution of polyvinyl alcohol, and sodium dichromate was also added to the suspension. The ratio of polyvinyl alcohol to sodium dichromate was 10:1.

The suspension of the pigment was provided on the dielectric layer 4 of a front plate 1, which comprised a glass plate 3, a dielectric layer 4, and discharge electrodes 6, 7, by means of spin coating. The dielectric layer 4 comprised glass containing PbO, and the two discharge electrodes 6, 7 were made of ITO.

The layer was irradiated with UV light through a mask, and the polymer was cross-linked in the exposed regions. The non-cross-linked color filter regions were washed off by spraying with hot water. The green color filter layer 8 was structured such that the green color filter layer 8 was positioned opposite the green phosphors in the phosphor layer 10. Then a protective layer 5 of MgO was provided on the green color filter layer 8.

The entire front plate 1 was dried and given an aftertreatment for two hours at 400° C. The layer thickness of the green color filter layer 8 was 1.0 μm.

In addition, a suspension of the green-emitting phosphor $LaPO_4$:Ce,Tb was prepared, to which additives such as an organic binder and a dispersing agent were added. The suspension was provided on a carrier plate 2 of glass with address electrodes 10 of ITO and with a ribbed structure 13 by means of silk-screen printing and dried. This process step was carrier out consecutively for the other two phosphor types with the emission colors blue and red. All organic additives remaining in the phosphor layer 10 were removed by a thermal treatment of the carrier plate 2 in an atmosphere containing oxygen at 400 to 600° C.

Subsequently, the front plate 1 and the carrier plate 2 together with a gas mixture comprising 7% Xe and 93% Ne by volume were used for assembling an AC plasma picture screen.

Embodiment 2

To manufacture a front plate 1 with a green color filter layer 8, first 62.5 g copper-1,2,3,4,8,9,10,11,15,16,17,18,22,23,24,25-hexadecachloro-29H,31H-phthalocyanine was stirred into a dispersing agent solution of 31.25 g of a pigment-affinated dispersing agent in 530 g water, under vigorous stirring. The resulting suspension was mixed with 10 g of a 5% aqueous solution of a non-ionogenic anti-foaming agent and milled in a ball mill containing glass balls. The ball mill was filled such that the suspension just covered the glass balls, and the rotation speed was set for approximately 50 rpm. A stable, fine-particle suspension was obtained after two days and filtered off through a filtering gauze.

The suspension was mixed with a 10% solution of polyvinyl alcohol, and sodium dichromate was also added to the suspension. The ratio of polyvinyl alcohol to sodium dichromate was 10:1.

The suspension of the pigment was provided on the dielectric layer 4 of a front plate 1, which comprised a glass plate 3, a dielectric layer 4, and discharge electrodes 6, 7, by means of spin coating. The dielectric layer 4 comprised glass containing PbO, and the two discharge electrodes 6, 7 were made of ITO.

The layer was irradiated with UV light through a mask, so that the polymer was cross-linked in the exposed regions.

Then the non-cross-linked color filter regions were washed off by spraying with hot water. The green color filter layer 8 was structured such that the green color filter layer 8 was situated opposite the green phosphors in the phosphor layer 10. Then an additional red color filter layer was provided in a structured manner opposite the regions of the phosphor layer comprising a red phosphor in a similar manner, and an additional blue color filter layer was provided in a structured manner opposite the regions of the phosphor layer 10 comprising a blue phosphor. The red color filter layer comprised $Fe_2O_3$, and the blue color filter layer comprised $CoO—Al_2O_3$. A protective layer 5 of MgO was provided over the color filter layers.

The entire front plate 1 was dried and given an aftertreatment for two hours at 400° C. The layer thickness of the green color filter layer 8 was 0.5 $\mu$m.

In addition, a suspension of the green-emitting phosphor $YBO_3$:Tb was prepared, to which additives such as an organic binder and a dispersing agent were added. The suspension was provided on a carrier plate 2 of glass with address electrodes 10 of ITO and with a ribbed structure 13 by means of silk-screen printing and dried. This process step was carrier out consecutively for the other two phosphor types with the emission colors blue and red. All organic additives remaining in the phosphor layer 10 were removed by a thermal treatment of the carrier plate 2 in an atmosphere containing oxygen at 400 to 600° C.

Subsequently, the front plate 1 and the carrier plate 2 together with a gas mixture comprising 10% Xe and 90% Ne by volume were used for assembling an AC plasma picture screen.

What is claimed is:

1. A plasma picture screen comprising:

a front plate including a glass plate on which a dielectric layer and a protective layer are provided;

a carrier plate provided with a phosphor layer including a red and a blue phosphor as well as a green Tb3+-activated phosphor, with a ribbed structure which subdivides the space between the front plate and the carrier plate into gas-filled plasma cells; and a green color filter layer, wherein one or several electrode arrays are provided on the front plate and the carrier plate for generating corona discharges in the plasma cells.

2. The plasma picture screen of claim 1, wherein the green color filter layer lies between the dielectric layer and the protective layer.

3. The plasma picture screen of claim 1, wherein the green color filter layer lies in a structured manner opposite regions of the phosphor layer that have the green Tb3+-activated phosphor.

4. The plasma picture screen of claim 1, wherein the color filter layer includes copper phthalocyanine or a derivative of copper phthalocyanine.

5. The plasma picture screen of claim 1, wherein the green Tb3+-activated phosphor is chosen from the group (YxGd1-x)BO3:Tb (0≦x≦1), LaPO4:Tb, (YxGd1-x)3Al5O12:Tb (0≦x≦1), CeMgAl11O19:Tb, GdMgB5O10:Ce,Tb, (YxGd1-x)2SiO5:Tb (0≦x≦1), (InxGd1-x)BO3:Tb (0≦x≦1), Gd2O2S:Tb, LaOBr:Tb, LaOCl:Tb, and LaPO4:Ce,Tb.

6. The plasma picture screen of claim 3, wherein an additional red color filter layer lies in a structured manner opposite regions of the phosphor layer that have the red phosphor.

7. The plasma picture screen of claim 3 or 6, wherein an additional blue color filter layer lies in a structured manner opposite regions of the phosphor layer that have the blue phosphor.

* * * * *